US008920709B2

(12) United States Patent
Maggioli et al.

(10) Patent No.: US 8,920,709 B2
(45) Date of Patent: Dec. 30, 2014

(54) COOLING PLATE FOR A METALLURGICAL FURNACE

(75) Inventors: Nicolas Maggioli, Thionville (FR); Dallas Garratt, Neudorf (LU)

(73) Assignee: Paul Wurth S.A., Luxembourg (LU)

( * ) Notice: Subject to any disclaimer, the term of this patent is extended or adjusted under 35 U.S.C. 154(b) by 295 days.

(21) Appl. No.: 13/264,435

(22) PCT Filed: Apr. 12, 2010

(86) PCT No.: PCT/EP2010/054770
§ 371 (c)(1), (2), (4) Date: Oct. 14, 2011

(87) PCT Pub. No.: WO2010/119013
PCT Pub. Date: Oct. 21, 2010

(65) Prior Publication Data

US 2012/0056361 A1 Mar. 8, 2012

(30) Foreign Application Priority Data

Apr. 14, 2009 (LU) ..... 91551

(51) Int. Cl.

| | |
|---|---|
| ***B21D 53/02*** | (2006.01) |
| ***C21B 7/10*** | (2006.01) |
| ***F27B 1/24*** | (2006.01) |
| ***F27D 1/12*** | (2006.01) |
| *F27D 9/00* | (2006.01) |

(52) U.S. Cl.
CPC ... *C21B 7/10* (2013.01); *F27B 1/24* (2013.01); *F27D 1/12* (2013.01); *F27D 2009/0051* (2013.01)
USPC ..... 266/194; 266/241

(58) Field of Classification Search
USPC ..... 266/193, 194, 241
See application file for complete search history.

(56) References Cited

U.S. PATENT DOCUMENTS

| | | | | |
|---|---|---|---|---|
| 4,121,809 | A * | 10/1978 | Dhelft | 266/193 |
| 4,437,651 | A * | 3/1984 | Cordier et al. | 266/193 |
| 6,742,699 | B2 | 6/2004 | Saarinen et al. | |
| 6,911,176 | B2 | 6/2005 | Saarinen | |
| 2012/0056361 | A1 | 3/2012 | Maggioli et al. | |

FOREIGN PATENT DOCUMENTS

| | | |
|---|---|---|
| CN | 2461931 Y | 11/2001 |
| CN | 2479025 Y | 2/2002 |
| CN | 2545210 | 4/2003 |

(Continued)

OTHER PUBLICATIONS

Chinese Office Action for corresponding applciation 201080016774.3 filed Apr. 12, 2010; Mail date Jan. 31, 2013.

(Continued)

*Primary Examiner* — Scott Kastler
(74) *Attorney, Agent, or Firm* — Cantor Colburn LLP

(57) ABSTRACT

A cooling plate (10) for a metallurgical furnace comprises a body (12) with a front face (14) and an opposite rear face (16), as well as coolants channel (18) therein; a plurality of lamellar ribs (24) on its front face, two consecutive ribs (24) being spaced by a groove (22); and inserts (26) fixed in the grooves (22) and projecting from the front face (14). The inserts (26) have an upper side projecting from the bottom edge of the rib directly above, which is configured so as to form a collecting surface (28) on which, in use, furnace burden material accumulates up to the top edge (32) of the rib (24) directly above.

17 Claims, 2 Drawing Sheets

(56) References Cited

FOREIGN PATENT DOCUMENTS

| | | | |
|---|---|---|---|
| CN | 1886522 | A | 12/2006 |
| DE | 7331936 | U | 2/1974 |
| DE | 2907511 | C2 | 9/1980 |
| EP | 0052039 | A1 | 5/1982 |
| FR | 2169649 | A | 9/1973 |
| JP | 56010292 | U | 1/1981 |
| JP | 63192805 | A | 8/1988 |
| JP | 63192806 | A | 8/1988 |
| UA | 20880 | U | 2/2007 |
| WO | 0063446 | A1 | 10/2000 |

OTHER PUBLICATIONS

International Search Report issued Sep. 21, 2009 re: PCT/EP2009/056846; citing: CN 2 479 025 Y, JP 63 192806 A and JP 63 192805 A.

English translation of examination report, dated Sep. 12, 2013, relating to the corresponding Ukrainian patent application No. a 2011 13013. Citing UA 20 880 U.

International Search Report PCT/EP2010/054770; Dated Aug. 31, 2010.

* cited by examiner

COOLING PLATE FOR A METALLURGICAL FURNACE

TECHNICAL FIELD

The present invention generally relates to a cooling plate for a metallurgical furnace and its method of manufacturing.

BACKGROUND ART

Cooling plates for metallurgical furnaces, also called staves, are well known in the art. They are used to cover the inner wall of the outer shell of the metallurgical furnace, as e.g. a blast furnace or electric arc furnace, for two main reasons. The first function of the cooling plates is to provide a heat evacuating protection screen between the interior of the furnace and the outer furnace shell.

Originally, the cooling plates have been cast iron plates with cooling pipes cast therein. As an alternative to cast iron staves, copper staves have been developed. Nowadays, most cooling plates for metallurgical furnaces are made of copper, copper alloy or, more recently, of steel.

The second function of the cooling plates is to provide an anchoring means for a refractory brick lining, a refractory guniting or a process generated accretion layer inside the furnace. Hence, for improved anchoring, they are typically provided on their front side with alternating lamellar ribs and grooves.

U.S. Pat. No. 4,437,651 describes a blast furnace comprising cast iron cooling plates mounted on the inner wall side of the blast furnace's armour. Conventionally, the cooling plates have a panel shaped body with cooling passages arranged therein. The front side of the cooling panel, i.e. facing the furnace interior and to which the refractory lining is fixed, comprises alternating ribs and grooves. The grooves have a dove-tail cross-sectional shape and inserts having a corresponding trapezoidal shape are affixed within the grooves and project from the front side. The inserts are made from silicon carbide and placed in situ when casting the iron of the cooling plate. They are intended to improve the connection between the cast iron and the refractory lining.

In the furnace, the cooling plates with their concrete/refractory lining are subject to important heat and mechanical deformation resulting from high fluxes in the blast furnaces. The concrete/refractory lining is particularly sensitive to such mechanical stresses, and is further subject to high wearing due to abrasion caused by the burden material descending through the blast furnace.

BRIEF SUMMARY

The invention provides an alternative cooling plate that is less subject to abrasion by the burden material in the furnace.

According to the present invention, a cooling plate for a metallurgical furnace, especially a blast furnace, comprises a body with a front face and an opposite rear face; and a plurality of lamellar ribs on its front face, two consecutive ribs being spaced by a groove. Inserts are fixed in the grooves and project from the front face.

According to an important aspect of the present invention, the inserts have an upper side projecting from the bottom edge of the rib directly above, which is configured so as to form a collecting surface on which, in use, furnace burden material accumulates up to the top edge of the rib directly above, whereby the whole height of the rib is covered by burden material.

The present invention is based on the principle that when burden material has accumulated on the collecting surfaces of the inserts, thus filling the recesses between two adjacent inserts with burden material, this accumulated burden material forms a protecting layer for the front side of the cooling plate. Indeed, since the accumulated burden material is located between the inserts in front of the ribs, the descending burden material does normally not come into contact with the surface of the cooling plate itself, but is in contact with the accumulated burden material. Hence, rubbing occurs between accumulated and descending burden material, avoiding direct rubbing against the front side and thus limiting abrasion of the cooling plate.

The burden material in the metallurgical furnace, which includes iron-bearing material (mainly ore, sinter or pellets) as well as coke and other materials required for the furnace operation, is mostly in granular form. Accordingly, to ensure a proper filling of the recesses defined in-between the inserts mounted in two adjacent grooves, the design of the accumulating surfaces is advantageously done to take into account the angle of repose of burden material. As it is known in the art, the term "angle of repose" designates, having regard to granular materials, the maximum angle of a stable slope of a pile of such granular material. Indeed, as it is well known, when bulk granular materials is poured onto a horizontal base surface, a conical pile forms. The internal angle between the surface of the pile and the base surface is known as the angle of repose; essentially, the angle of repose is the angle a pile forms with the horizontal.

The collecting surface may be substantially flat or concave. Preferably, the collecting surface is configured to be substantially horizontal or beveled towards the cooling plate when the cooling plate is installed in the metallurgical furnace. In this connection, it may be noted that, as it is known in the art, cooling plates are arranged over the height of the blast furnace at different angles relative to the vertical, depending on whether they are erected in the bosh, belly or stack region. Accordingly, in the present invention the inserts are advantageously designed so that their collecting surface is appropriately configured depending on the inclination of the wall portion against which it is to be mounted.

To take into account the angle of repose of the burden material, the inserts are advantageously configured so that the angle $\beta$ between the vertical and a line passing trough the upper front edge of the insert and the top edge of the above rib is no less than $90-\alpha$, where $\alpha$ represents, in degrees, the angle of repose of the burden material.

In view of the granulometry of the burden material conventionally employed in the blast furnace, a typical angle of repose is about 40°, say between 35° and 45°. Hence, the inserts shall preferably be configured so that their upper front edge is sufficiently away from the front face so that the angle $\beta$ between the vertical and the line passing through the upper front edge and the top edge of the rib directly above is no less than about 45° to 50°.

As it will be understood by those skilled in the art, the reduction of abrasion due to rubbing by use of the present inserts that allow substantive accumulation of burden material on the inserts avoiding direct contact with the cooling plate is designed, when applied to blast furnaces, for the steady state operation. However, for the so-called blowing-in (the process of starting the blast furnace using specially arranged materials and burden to coke ratio, as it is known in the art) the present cooling staves are preferably covered by a gunite concrete layer on the front side, or other protective layer.

An accretion layer may form on the hot faces of the ribs, in between the inserts, where liquid material may freeze. Also, the inserts are preferably press-fitted into the grooves to ensure an optimal heat transfer between the copper staves and the inserts, thus allowing the inserts to freeze liquid material as well and form an accretion layer.

With respect to the mounting of the inserts in the grooves, they are preferably inserted in the grooves when the cooling plate is in a hot (heated) state, to benefit from the thermal expansion thereof. When cooling down, metal retraction will cause a tight (interfering) contact that results in good fixation (locking) of the inserts as well as good thermal exchange with the cooling plate. Preferably, the grooves have a dovetail cross-sectional shape and the base portion of the inserts fitted therein has a mating shape. Hence, the inserts are elements that are advantageously set in place in the already manufactured or in an existing cooling plate body (i.e. the inserts are fixed in a solidified cooling plate body with ribs and grooves, but not installed during a casting operation of the cooling plate).

In one embodiment, the inserts have a projecting portion that has a cross sectional shape at least partially tapering in a direction away from said cooling plate front face. This facilitates the flow of material in the recess below. However more rectangular or other cross-sectional shapes can be used for the inserts, as long as these inserts project sufficiently away from the front face so that material may accumulate on the projecting upper side (forming the collecting surface).

According to another aspect of the invention, a metallurgical furnace comprises an outer shell, the inner wall of the outer shell being covered by the present cooling plates. The inserts are advantageously configured so that their collecting surface forms a horizontal angle or is beveled to retain matter. Depending on the blast furnace region in which cooling plate is installed, the insert configuration may thus differ:

in the case of cooling plates mounted in the bosh region, the inserts may be configured so that their collecting surface forms an angle of between 85° and 110° degrees with respect to the front face of the cooling plate;

in the case of cooling plates are mounted in the stack region, the inserts may be configured so that their collecting surfaces form an angle of between 65° and 85° degrees with respect to the front face of the cooling plate;

in the case of cooling plates mounted in the belly region of a blast furnace, the inserts may be configured so that their collecting surfaces form an angle of between 75° and 90° degrees with respect to the front face of the cooling plate.

According to a further aspect, the present invention also concerns an insert for a cooling plate, the insert having a base portion to be locked in a groove in a front side of a cooling plate, and a projecting portion that extends from the cooling plate front side when the insert is fixed in the groove. The insert base portion and groove have mating shapes, e.g. a dove tail cross-section. The projecting portion preferably tapers in the direction away from the base portion (and thus away from the cooling plate front side). However, the projecting portion is configured so that, in use, its upper side is essentially horizontal or beveled towards the front side of the cooling plate. Where the insert is to be used on a cooling plate to be mounted in the stack or bosh region of a blast furnace, there may thus be a sensible angle between the centerlines of the base and projecting portions of the insert. Furthermore, the projecting portion of the insert is advantageously configured to take into account the angle of repose of the burden material. One may thus design the insert so that burden material accumulates on the insert's upper surface up to the insert directly above. Alternatively, one may adjust between the inclination of the cooling plate, the length of the insert collecting surface and the shade provided by the insert directly above, whereby although the collecting surface is not designed to allow material accumulation over the whole height of the directly above rib, the upper portion thereof is protected by the shade provided by the insert directly above.

According to a further aspect of the present invention, there is presented a method of manufacturing a cooling plate.

BRIEF DESCRIPTION OF THE DRAWINGS

Preferred embodiments of the invention will now be described, by way of example, with reference to the accompanying drawings, in which.

DETAILED DESCRIPTION

Figure 1:
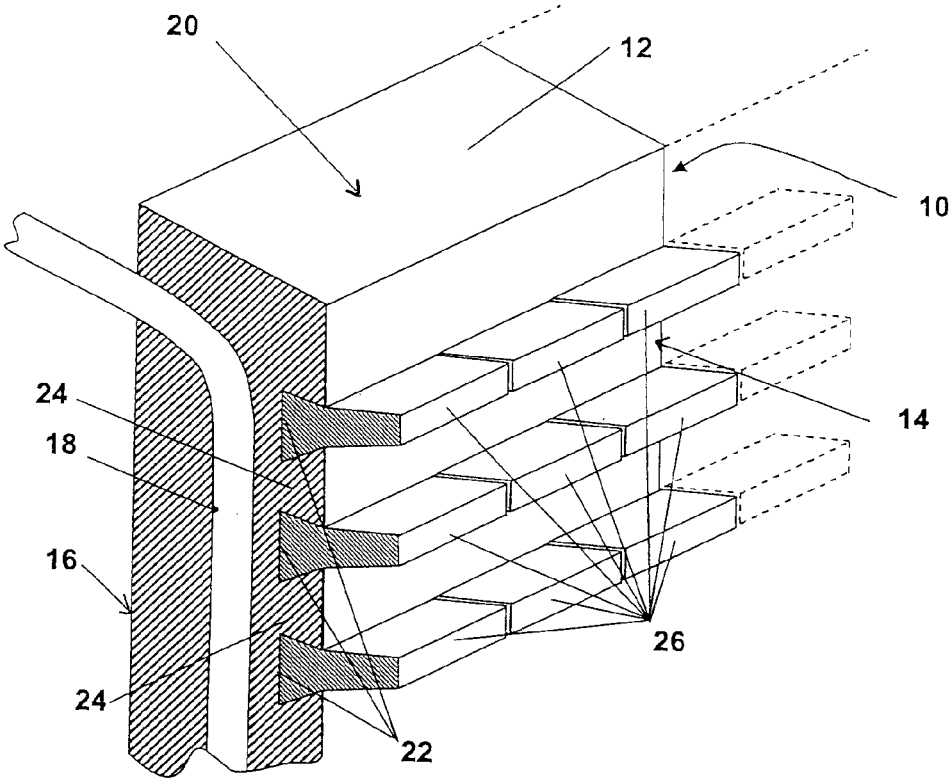
FIG. 1: is a perspective view, with the side edge cut away, of a preferred embodiment of the present cooling plate.
Figure 2:
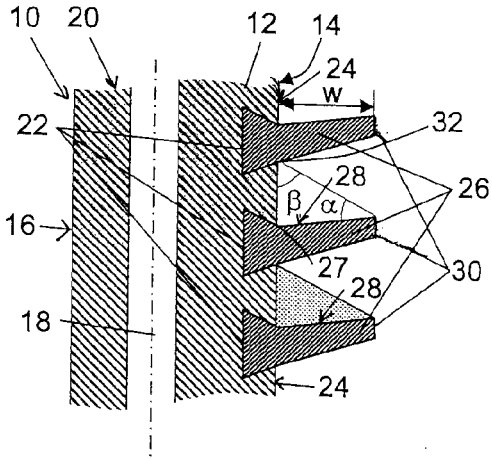
FIG. 2: is a vertical cross-sectional view through the cooling plate of FIG. 1.

A preferred embodiment of the present cooling plate 10 is illustrated in FIGS. 1 and 2. The cooling plate 10 is typically formed from a slab e.g. made of a cast or forged body of copper, copper alloy or steel into a panel-like body 12. This panel-like metallic body 12 has a front face 14, also referred to as hot face, which will be facing the interior of the furnace, and a rear face 16, also referred to as cold face, which will be facing the inner surface of the furnace wall. Conventionally, the panel-like body 12 is of essentially parallelepipedic form. Most modern cooling plates have a width in the range of 600 to 1300 mm and a height in the range of 1000 to 4200 mm. It will however be understood that the height and width of the cooling plate may be adapted, amongst others, to structural conditions of a metallurgical furnace and to constraints resulting from their fabrication process.

A plurality of coolant channels 18 extend through the body 12 in proximity of the rear face 16, from the region of one side edge 20 to the region of the opposite side edge (not shown). The coolant channels 18 may be drilled in the body 12 and connected to a coolant circuit outside the furnace wall via appropriate connecting pipe/channel. Alternatively the coolant channels may be cast-in channels or embedded pipes.

The front face 14 of the cooling plate is subdivided by means of grooves 22 into lamellar ribs 24. The grooves 22, laterally delimiting the lamellar ribs 24, may be milled or more generally machined into the front face 14 of the panel-like body 12. The lamellar ribs 24 extend parallel to one another. They are preferably perpendicular to the cooling channels 18 in the panel-like body 12. When the cooling plate 10 is mounted in the furnace, the grooves 22 and lamellar ribs 24 are arranged substantially perpendicular to the vertical.

It shall be appreciated that inserts 26 are fixed in the grooves 22 and project from the front face 14. As it can be seen from the Figures, the inserts 26 have an upper side 28 projecting from the bottom edge 27 of the rib 24 situated directly above and is configured to form a collecting surface for the burden material in the metallurgical furnace. It is to be particularly appreciated that this collecting surface 28 is configured so that the burden material may accumulate up to the top edge of the rib 24 directly above.

Furthermore, the collecting surface 28 is advantageously dimensioned to take into account the angle of repose of the granular burden material in the furnace. This implies that the collecting surface should have a width W (distance from the rib directly above to the upper, front edge of the insert) sufficient so that material may accumulate over the whole height of the recess defined between the two bordering inserts 26, against the corresponding rib 24.

Another way of expressing this condition is that inserts 26 must be designed so that their upper front edge 30 is positioned such that the angle, noted β, between the vertical and a line passing trough the upper front edge 30 of the insert and the top edge 32 of the rib directly above is calculated as $\beta \geq 90° - \alpha$, where α represents, in degrees, the angle of repose of the burden material (see FIG. 2).

In view of the granulometry of the burden material conventionally employed in the blast furnace, a typical angle of repose is about 40°, say between 35 and 45°. Hence, the inserts shall preferably have a collecting surface configured so as to be horizontal or beveled towards the front face 14, and the upper front edge of the insert 30 is sufficiently away from the front face 14 so that the angle β between the vertical the line passing through the upper front edge 30 and the top edge 32 of the rib directly above is no less than about 45° to 50°.

Figure 3:
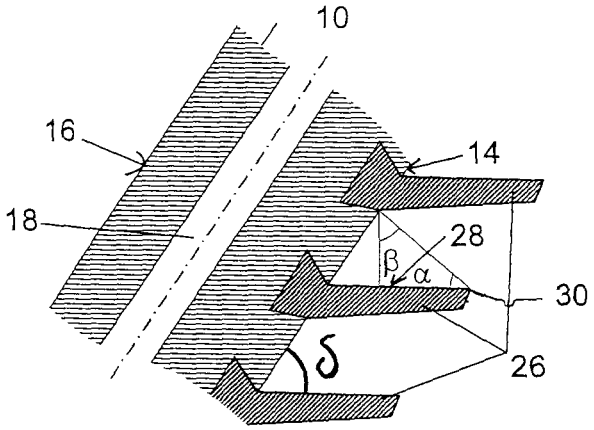
FIG. 3: is a section view through another embodiment of the present cooling plate, as configured for use e.g. in the stack region of a blast furnace.

As it is known to those skilled in the art, in a metallurgical furnace such as a blast furnace, the cooling plates are vertically arranged in the belly region only, but in the bosh and stack region the furnace walls are oblique and the cooling plates inclined in the same way. Therefore, the inserts 26 shall preferably be adapted to the intended mounting region of the cooling plates, so that the configuration of the collecting surface 28 may be adapted. While the embodiment of FIGS. 1 and 2 concern a cooling plate for mounting in the belly region of a blast furnace, FIG. 3 illustrates another embodiment of the present cooling plate where the inserts 26' are adapted for mounting in the stack-region of a blast furnace.

Generally, the collecting surface 28 may be substantially flat or concave. It is preferably designed so that, upon mounting on the furnace wall, it extends in a horizontal plane, or in a plane inclined upwards in a direction away from the front side 14. A comparison between FIGS. 2 and 3 makes it clear how one may adapt the configuration of the projecting portion of the inserts 26 depending on the mounting angle of the cooling plate. As it appears, there may be an important angle between the centerlines of the base and projecting portions of the insert when the insert is designed to be used on a cooling plate that will be mounted in the stack (or bosh) region of a blast furnace.

Preferably, the configuration of inserts 26, and in particular of their projecting portion, is adapted so that the collecting surface 28 forms a predetermined angle δ (see FIG. 3) with respect to the front face 14 of the cooling plate:

for a cooling plate mounted in the bosh region of a blast furnace, δ may be in the range from 85° to 110°, preferably 95° to 110°;

for a cooling plate mounted in the stack region, δ may be in the range from 65° to 85°;

for a cooling plate mounted in the belly region, δ may be in the range from 75° to 90, preferably 75° to 85°.

The inserts 26 are advantageously made from wear resistant steel or cast iron, or hard ceramic material such as e.g. SiC.

The inserts 26 are preferably arranged so that they extend over the whole width of the cooling plate 10 (i.e. each groove 22 is filled by the inserts 26 over its whole length). This may be done using a single insert having a length corresponding to the cooling plate's width. But in the present embodiments several inserts 26 are arranged in a row in each grove 22 to cover the cooling plate's width.

For a secure mounting of the inserts 26 in the grooves 22, the latter preferably have a dove-tail cross-sectional shape and the base portion (fitting in the groove) of the inserts 26 has a mating shape. For a further increased locking effect, the inserts 26 are fitted in the grooves 22 when the cooling plate 10 is in a hot state, so that upon cooling metal contraction will lead to an interference fit between grooves 22 and inserts 26. Here, it is to be understood that the inserts are set in place in a manufactured (solid) cooling plate body (after production by casting and forging). The term interference fit conventionally refers, in accordance with its conventional meaning, to the fact that one part (from two mating parts) slightly interferes with the space that the other is taking up. Here, thermal expansion is used to broaden the groove 22 and facilitate the introduction of the inserts therein.

In this connection, the grooves 22 typically extend essentially over the whole width of the cooling plate and thus open into at least one (typically both) lateral sides. The inserts 26 are thus typically introduced into the milled grooves 22 through this opening from the lateral side.

For improved progression of burden material in the furnace, the projecting portion of the inserts 26 preferably has a cross-sectional shape at least partially tapering in a direction away from the front side 14. This kind of truncation of the lower front edge of the insert 26 forms a flowing edge that facilitates the flow of material in the recess located beneath and avoids turbulence.

The invention claimed is:

1. A cooling plate for a metallurgical furnace comprising:

a body with a front face and an opposite rear face, said body having at least one coolant channel therein;

a plurality of lamellar ribs on its front face, each rib having a top edge and a bottom edge, and two consecutive ribs being spaced by a groove;

inserts fixed in the grooves and projecting from the front face, wherein said inserts have an upper side projecting from the bottom edge of the rib directly above and an upper front edge;

wherein the angle (β) between the vertical and a line passing through the upper front edge of the insert and the top edge of the above rib is no less than 45°, whereby said upper side forms a collecting surface taking into account the angle of repose of the burden material so that, in use, furnace burden material may accumulate on said collecting surface up to the top edge of said rib directly above.

2. The cooling plate according to claim 1, wherein β is no less than 50°.

3. The cooling plate according to claim 1, wherein said inserts are fixed into the grooves of a solid cooling plate body.

4. The cooling plate according to claim 1, wherein said grooves are machined in said cooling plate body before said inserts are fixed therein.

5. The cooling plate according to claim 2, wherein said inserts are secured by interference-fit in the grooves.

6. The cooling plate according to claim 1, wherein said inserts are made from wear resistant material.

7. The cooling plate according to claim 1, wherein said grooves have a substantially dovetail cross-sectional shape and the base portion of said inserts fitted therein has a mating shape.

8. The cooling plate according to claim 1, wherein said inserts have a projecting portion that has a cross sectional shape at least partially tapering in a direction away from said cooling plate front face.

9. The cooling plate according to claim 1, wherein said inserts are configured so that their collecting surface is, in use, substantially horizontal or beveled towards said front side.

10. The cooling plate according to claim 6, wherein the projecting portion of the insert forms an angle with respect to the base portion.

11. The cooling plate according to claim 7, wherein said collecting surface forms with said front face of said cooling plate and a predetermined angle δ selected from the group consisting of: [85°; 110° ]; [65°; 85° ]; and [75°; 90° ].

12. A metallurgical furnace comprising an outer shell, the inner wall of said outer shell being covered by a plurality of cooling plates according to claim 1.

13. The metallurgical furnace according to claim 10, wherein said cooling plates are mounted in the bosh region of a blast furnace, and wherein the inserts are configured so that their collecting surface form an angle of between 85° and 110° with respect to the front face of the cooling plate.

14. The metallurgical furnace according to claim 10, wherein said cooling plates are mounted in the stack region of a blast furnace, and wherein the inserts are configured so that their collecting surfaces form an angle of between 65° and 85° with respect to the front face of the cooling plate.

15. The metallurgical furnace according to claim 10, wherein said cooling plates are mounted in the belly region of a blast furnace, and wherein the inserts are configured so that their collecting surfaces form an angle of between 75° and 90° degrees with respect to the front face of the cooling plate.

16. A method of manufacturing a cooling plate comprising:

providing a metallic body with a front face and an opposite rear face, said body having at least one coolant channel therein;

machining said body to provide a plurality of lamellar ribs on its front face, two consecutive ribs being spaced by a groove, wherein each grooves opens into at least one lateral side of the body;

fixing inserts in said grooves by introducing them through the opening in the lateral side of the body, wherein, upon mounting, said inserts have an upper side projecting from the bottom edge of the rib directly above, and wherein the angle (β) between the vertical and a line passing through the upper front edge of the insert and the top edge of the above rib is no less than 45°, whereby said upper side forms a collecting surface, which is configured so as to form a collecting surface; wherein said collecting surface is dimensioned to take into account the angle of repose of the burden material.

17. The cooling plate according to claim 1, wherein said inserts are made from cast iron or steel.

* * * * *